United States Patent [19]

Larson et al.

[11] Patent Number: 4,677,791

[45] Date of Patent: Jul. 7, 1987

[54] ADJUSTABLE GATE FOR DOORWAYS

[75] Inventors: Donald A. Larson, Circle Pines; Peter M. Runyon, St. Paul, both of Minn.

[73] Assignee: North States Industries, Inc., Minneapolis, Minn.

[21] Appl. No.: 873,994

[22] Filed: Jun. 13, 1986

[51] Int. Cl.[4] ..... E06B 3/32

[52] U.S. Cl. ..... 49/463; 49/55; 49/57; 160/215

[58] Field of Search ..... 49/55, 57, 463, 61, 49/465, 466; 160/225, 215, 217, 216, 222; 248/205.3, 264, DIG. 11, 558, 200.1; 211/123

[56] References Cited

U.S. PATENT DOCUMENTS

| | | | |
|---|---|---|---|
| 905,142 | 12/1980 | Bond | 248/264 |
| 1,515,454 | 11/1924 | Wilson | 49/463 |
| 2,199,851 | 5/1940 | Culver | 248/264 |
| 2,803,471 | 8/1957 | Roth | 49/57 X |
| 2,928,146 | 3/1960 | Kuniholm | 49/55 X |
| 3,163,205 | 12/1964 | Gottlieb | 49/55 X |
| 3,942,576 | 3/1976 | Rickard | 49/55 X |
| 4,004,325 | 1/1977 | Hubachek | 248/205.3 X |
| 4,367,819 | 1/1983 | Lewis | 248/205.3 X |
| 4,437,265 | 3/1984 | Turro et al. | 49/57 |

FOREIGN PATENT DOCUMENTS

| | | | |
|---|---|---|---|
| 212089 | 5/1957 | Australia | 49/55 |

*Primary Examiner*—Philip C. Kannan

*Attorney, Agent, or Firm*—Merchant, Gould, Smith, Edell, Welter & Schmidt

[57] ABSTRACT

A mounting device is disclosed for a portable, expansion-type security gate for children or pets. The expansion gate has a variable width with frictional bumpers on each side that frictionally engage a door jamb or other doorway defining member. The mounting device consists of a socket defining mounting member for each frictional bumper that is secured to the door jamb and is configured to receive and retain the frictional bumper. One type of mounting member is configured to mount on flat surfaces such as door jambs and walls. Another mounting member is constructed to mount on a wrought iron railing. Both types rigidly support the security gate and prevent it from being accidentally dislodged.

19 Claims, 6 Drawing Figures

FIG. 1
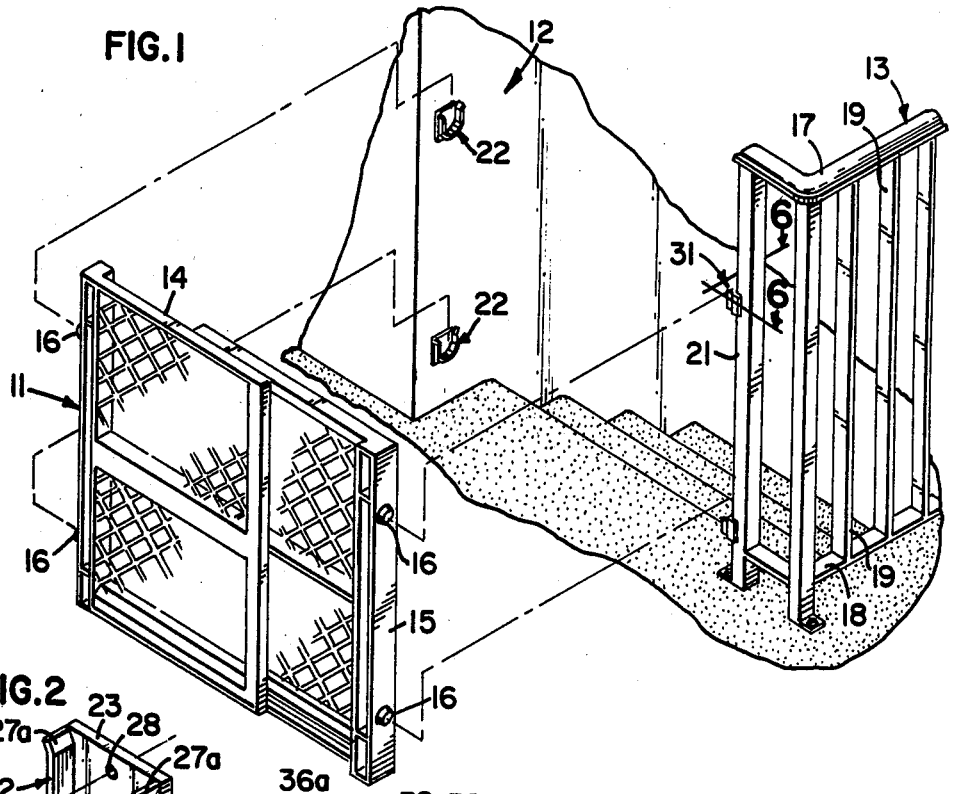
FIG. 2
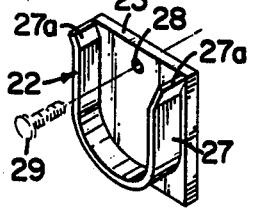
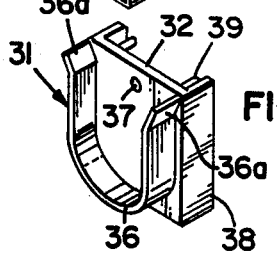
FIG. 4
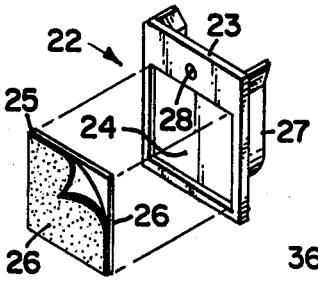
FIG. 3
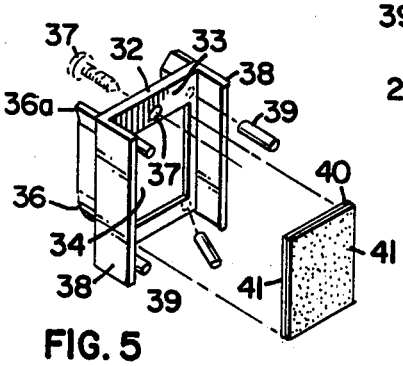
FIG. 5
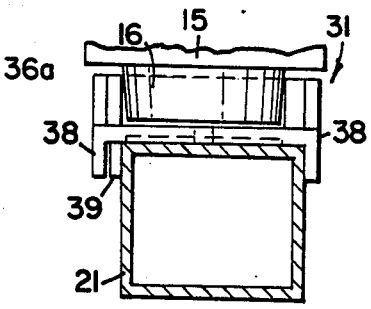
FIG. 6

ADJUSTABLE GATE FOR DOORWAYS

The invention broadly relates to security gates for children and pets, and is specifically directed to mounting apparatus for use with such security gates that can be used to insure that the gate will not be moved in any manner when it is in place.

Security gates provide an important function in the home where doors do not exist to keep children from leaving a safe area, as well as to prevent them from entering a dangerous area (e.g., a stairwell). These gates also find useful application in preventing pets from leaving areas in the house designated for the pet and from entering areas where the pet should not go.

Among various types of security gates available, most have relatively movable parts which enable it to expand laterally and increase its effective width. Frictional bumpers are provided on opposite sides of the gate for frictionally engaging opposite sides of a door jamb, and expansion of the gate places it under compression within the door jamb. In this state, the bumpers frictionally engage the door jamb and firmly hold the gate in place under most circumstances.

Although this approach lends itself to portability of security gates that are capable of functioning safely in the vast majority of cases, it has been difficult to use such security gates in conjunction with wrought iron railings, particularly where the opening leads to a stairwell. Here, the risk that the security gate can be dislodged increases, which precludes the gate from accomplishing its intended purpose.

In addition, consumers' safety groups have recently placed standards on security gates of this type, requiring them to withstand certain minimum forces that are imposed laterally on the gate. Where the gate can withstand such lateral forces, it is extremely difficult for a child or pet to dislodge the gate from its intended position.

This invention is the result of an endeavor to provide a mounting device for portable security gates that exceeds all applicable safety standards while at the same time being inexpensive to purchase and simple to use.

The inventive mounting device consists of a small socket defining member that is easily mounted on a door jamb, wall or other flat surface as well as onto the vertical post of a wrought iron railing. Each socket defining member is constructed and arranged to receive and retain a frictional bumper member on the security gate in such a way that the gate cannot be laterally moved or dislodged in any way.

Two specific types of socket defining members are used. The first is for door jambs and other flat surfaces, and it includes a rectangular base with front and back faces, the back face of which is flat to correspond to the flat surface upon which it is mounted. In the preferred embodiment, the back face includes a shallow recess in which a double-faced adhesive backing member is placed. The backing member itself has adhesive properties sufficient to hold the mounting member and gate in place to exceed safety standards. The socket for the mounting member is defined by a U-shaped rib that projects forwardly from the front face, and is adapted to receive and retain a circular friction bumper. Other configurations are obviously possible, although circular friction bumpers are most prevelant.

The socket-defining mounting member for wrought iron rails is structurally similar to that for flat surfaces, but also is provided with rearwardly projecting sides that overlie the sides of the wrought iron post. Because wrought iron railing posts are available in a variety of sizes, the back base of the mounting member is also provided with groups of frangible members that can be selectively broken away to define a mounting channel corresponding in size to the width of the vertical post. The adhesive back on the mounting member, coupled with the vertical sides and frangible members, cause the mounting member to be held rigidly in place under virtually all circumstances.

Although the adhesive back is entirely adequate for the vast majority of mounting situations, each of the socket-defining mounting members is also provided with a screw mounting that can be inserted into the door jamb, wall or wrought iron post to provide additional strength and stability.

Each of the socket-defining gate mounting members is structurally simple and can be fabricated by plastic molding. As such, the plastic mounting members are inexpensive to purchase and easily installed. For example, the security gate user may choose to purchase several different sets of mounting members for different doorway openings in the same house.

By virtue of their unique construction, the inventive mounting members are capable of receiving and holding in place any security gate of the adjustable width type having friction bumpers in any doorway or similar opening, including stairwells and those defined in whole or in part by wrought iron railings or similar rails.

BRIEF DESCRIPTION OF THE DRAWINGS

FIG. 1 is an exploded fragmentary perspective view showing a security gate installed with the invention;

FIG. 2 is an enlarged perspective view showing a first embodiment of an inventive mounting socket as viewed from the front side thereof;

FIG. 3 is an enlarged perspective view of the inventive mounting socket of FIG. 2 as viewed from the backside thereof;

FIG. 4 is an enlarged perspective view of a second embodiment of the inventive mounting socket viewed from the front side thereof;

FIG. 5 is an enlarged perspective view of the inventive mounting socket of FIG. 4 from the rear side thereof; and FIG. 6 is an enlarged sectional view taken along the line 6—6 of FIG. 1.

DESCRIPTION OF THE PREFERRED EMBODIMENTS

With initial reference to FIG. 1, a child/pet security gate represented generally by the numeral 11 is intended for mounting at the head of a stairwell between a wall 12 and a wrought iron railing 13 using inventive mounting apparatus described in further detail below.

The child/pet security gate 11 is of the type disclosed in U.S. Pat. No. 4,607,455, which issued on Aug. 26, 1986 for an "Adjustable Gate for Doorways", and which is commonly owned by the assignee of this application and invention. Gate 11 includes relatively slidable gate sections 14, 15 that slide relatively to approximate the width of the doorway in which the gate 11 is to be mounted, and locking means (not shown) thereafter force the gate sections 14, 15 apart into a compressing relation with the doorway defining members and lock the gate 11 in this position. Small circular rubber bumpers 16 on the outside edges of the gate sections 14, 15 frictionally engage the door or wall surface to hold the gate 11 in position.

Reference is made to U.S. Pat. No. 4,607,455 for further details as to the structure and operation of the gate 11. However, it is to be understood that gate 11 is shown here for exemplary purposes only, and the inventive gate mounting devices may be used in conjunction with child/pet security gates of varying construction.

Wall 12 as shown in FIG. 1 is of conventional construction, defining a flat surface that the gate 11 may engage. Similarly, the wrought iron railing 13 is of conventional construction, including a top rail 17, bottom rail 18 with vertical members 19 welded therebetween. As shown in FIG. 1, the wrought iron railing 13 includes a corner section defined by larger vertical members 21 that extend to the floor and are rigidly secured thereto by bolts. It is important to mount the gate 11 on the floor mounted corner section of the wrought iron railing 13 since mounting it to the side of a longitudinal section of the railing 13 would not provide adequate backing.

With reference to FIGS. 2 and 3, a gate mounting device for walls, door jambs and similar flat surfaces is represented generally by the numeral 22. Device 22 is preferably molded from plastic, and comprises a rectangular base 23 the backside of which (FIG. 3) is flat for mounting on the flat surface of wall 12, a door jamb or the like. A shallow rectangular (square) recess 24 is formed in the rear flat face of the base 23 and is adapted to receive a square section 25 of a backing sheet that has an adhesive face on both sides covered by a protective sheet 26. The backing sheet 25 is slightly thicker than the depth of the recess 24 in order for the backing sheet to be adhesively secured to a backing surface.

The front face of device 22 is also flat, but has a U-shaped rib 27 projecting forwardly therefrom to define a socket, with the open part of the "U" facing upward. The radius of curvatuve of the U-shaped rib 27 is sized to receive one of the rubber bumpers 16 on gate 11. To facilitate entry of the bumper 16, the U-shaped rib 27 is flared outwardly at the top of each leg, as shown by the reference numeral *27a*.

A mounting hole 28 is formed through the full thickness of base 23 near its top to receive a mounting screw 29, which typically would be a wood screw.

With reference to FIGS. 4–6, a mounting device for the wrought iron railing 13 is represented generally by the numeral 31. Device 31 is also preferably molded from plastic, and also comprises a rectangular base 32 having a flat backside 33. A square shallow recess 34 is formed in the backside 33 to receive a backing sheet 40 with a protective cover 41 on each side.

The front side of base 32 is also flat and includes a forwardly projecting U-shaped rib 36 identical to the rib 27, including flared portions 36*a*. A mounting opening 37 is formed through the rectangular base 32 near its top to receive a sheet metal screw 37.

Mounting device 31 is different from device 22 in that it is formed with a pair of spaced, parallel sides 38 that project rearwardly from each side edge of the rectangular base 32 (FIG. 5).

Also projecting from the rear face 33 of base 32 are four integrally formed frangible pegs 39 that are arranged in pairs, with each pair disposed in parallel relation to the sides 38.

The mounting posts 21 of conventional wrought iron railing are generally square in cross section, the sides of which are typically 1 inch, $1\frac{1}{8}$ inches or $1\frac{1}{4}$ inches in size. The sides 38 and pegs 39 are spaced to accommodate any of these sizes. Thus, the inside lateral spacing between the pairs of pegs 39 is slightly greater than one inch, the inside dimension between each pair of pegs 39 and the farthest side 38 is $1\frac{1}{8}$ inches, and the inside dimension between the sides 38 themselves is $1\frac{1}{4}$ inches. The pegs 39 are frangibly constructed (i.e., they can be broken away as shown in FIG. 5), and selected removal of one or more pairs of pegs 39 thus accommodates any of the sizes of posts 21.

In the example shown in FIGS. 5 and 6, the wrought iron corner post 21 has a mounting side that is $1\frac{1}{8}$ inches in size, and accordingly, one pair of the pegs 39 is removed (FIG. 5) to accomplish the necessary spacing for the device 31 to fit onto the corner post 21.

In mounting the gate 11, four mounting devices 22 or 31 are necessary, two for each side of the gate 11 corresponding to the number of rubber bumpers 16. In this particular installation, since the gate 11 is intended to close the space between the wall 12 and wrought iron railing 13, two mounting devices 22 are used for the wall 12, and two mounting devices 31 are used for the railing 13.

Placement of the devices 22, 31 must of course be based on the spacing of the lower bumpers 16 relative to the bottom of the gate 11 and the space between the lower and upper bumpers 16. Placing the lower mounting devices in the correct position will insure sufficient clearance between the bottom of the gate and the floor while avoiding excessive clearance.

With this initial dimension in mind, one side of the protective sheeting 26 is removed from one of the backing sheets 25, and the sheet 25 is placed into the shallow recess 24 of one of the wall mounting devices 22. The other protective sheeting 26 is now removed, and the mounting device 22 is placed in the lower position as shown. While the adhesive backing sheet 25 will itself sufficiently hold the wall device 22 in place, additional mounting strength may be obtained by drilling a pilot hole in the wall 12 through the hole 28 and inserting a wood screw 29.

The upper wall device 22 is now placed directly above the lower wall device 22 in the same manner, the spacing therebetween being based on the spacing between rubber bumpers 16.

On the opposite side, a rail mounting device 31 is prepared for the corner post 21 by first removing four, two or none of the pegs 39, depending on the size of the corner post 21. As pointed out above, the width of the corner posts 21 where the rail device 31 will be mounted is $1\frac{1}{8}$ inches in width, thus necessitating the removal of two of the pegs 39 as shown in FIG. 5. If a burr is left from this removal, it may be filed off to insure that the rear face 33 will fit flush against the corner post 21.

The backing sheet 40 is now placed in the shallow square recess 34 by removal of one of the protective sheets 41, and following removal of the other protective sheet 41, the wall device 31 is adhesively pressed into place on the corner post 21 at a height above the floor corresponding to that of the lower wall devices 22. If further mounting strength is desired, a pilot hole may be drilled in the corner post 21 and a sheet metal screw 37 inserted. The upper rail device 31 is now placed on the corner post 21 in the same manner and at the same height as the upper wall device 22.

With the four mounting devices 22, 31 in place, the gate 11 may now be removably mounted in the stairwell opening. This is accomplished by initially placing the gate 11 between the mounting devices 22, 31, expanding the gate 11 by sliding the relatively movable sections 14, 15 apart to the approximate opening space, and thereafter lockably expanding the gate 11 and locking it through the means shown in U.S. Pat. No. 4,607,455. In this mounted position, a child or pet is safely prohibited from moving past the gate 11. The locking mechanism of the gate cannot be operated by a child or pet, and the mounting devices 22, 31 offer further security because they preclude any lateral force on the gate 11 from causing it to be dislodged or moved in any manner.

Notwithstanding the strength and security offered by the mounting devices 22, 31, the gate 11 is easily removed when necessary by releasing the gate locking mechanism and sliding the gate sections 14, 15 together.

It is to be reiterated that the mounting sockets 22 and/or 31 may be used with frictional bumpers 16 on any type of security gate if the width of the gate is adjustable to conform to the width of the opening to be secured. There are many types of security gates commercially available for this purpose having a variety of approaches to width adjustment.

Further, although the bumpers 16 are circular in this embodiment, it is possible for the bumpers and devices 22, 31 to be of different configurations without departing from the scope of the invention, so long as they are of complementing shape.

It is also possible to mount the security gate 11 through the use of hinges on one side and mounting devices on the other, also to the extent the width of the gate is capable of being adjusted. An example of such mounting is shown in U.S. Pat. No. 4,607,455, to which reference is made.

It will be appreciated from the foregoing that the inventive mounting devices 22, 31 permit the gate 11 to be mounted safely and securely in a variety of environments without concern that the gate 11 will be dislodged or moved in any manner.

What is claimed is:

1. In combination:

a portable security gate for doorways and the like, comprising relatively movable portions at least one of which has a side member with at least one projecting bumper formed from frictional material and of predetermined configuration, the security gate further comprising means for effective relative movement between said portions to vary the effective width of the gate and for urging the movable portions relatively apart to cause the frictional bumper to forceably engage a doorway defining member;

and a mounting socket comprising a base member having front and rear faces, the rear face being constructed to conform to said doorway defining member, and including means for adhesively securing the mounting socket to a doorway defining member in a postion to receive the frictional bumper, and the front face having means projecting forwardly therefrom to define a socket sized and configured to retainably receive the frictional bumper.

2. The combination defined by claim 1, wherein the security gate comprises two sides each of which includes a plurality of said bumpers and a mounting socket for each of the bumpers.

3. The combination defined by claim 1, wherein the base member further comprises at least one mounting hole formed therein, and further comprising a fastening screw for the mounting hole.

4. A mounting member for use with a security gate for doorways and the like having frictional side bumpers of predetermined configuration for engaging the doorway defining member, the mounting member comprising:

a base member having front and rear faces;

the rear face being constructed to conform to the doorway defining member;

means for securing the base member to the doorway defining member, comprising a shallow recess formed in the rear face of the base member;

a backing sheet with double faced adhesive disposed in the shallow recess, the thickness of the backing sheet approximating the depth of the recess;

at least one mounting hole formed through the base member;

and a fastening screw for the mounting hole;

and socket means associated with the front face of the base member defining a socket sized and constructed to retainably receive the security gate bumper.

5. The mounting member defined by claim 4, wherein the rear face of the base member is flat to permit mounting on doorway defining members with flat surfaces.

6. The mounting member defined by claim 4, wherein the socket means comprises a U-shaped rib projecting forwardly from the front face of the base member.

7. The mounting member defined by claim 6, wherein the open part of said U-shaped rib faces upward.

8. The mounting member defined by claim 7, wherein the top of each leg of the U-shaped rib is flared outward.

9. A mounting member for use with a security gate for doorways and the like having frictional side bumpers of predetermined configuration for engaging the doorway defining member, the mounting member comprising:

a base member having front and rear faces;

the rear face being constructed to conform to the doorway defining member and further comprising a pair of spaced, parallel side members projecting rearwardly from the rear face of the base member, the spaced side members constructed and arranged to fit over a rectangular post for a wrought iron railing or the like;

means for securing the base member to the doorway defining member;

and socket means associated with the front face of the base member defining a socket sized and constructed to retainably receive the security gate bumper.

10. The mounting member defined by claim 9, wherein the base member is rectangular, and the side members are disposed along opposed sides thereof.

11. The mounting member defined by claim 9, wherein a shallow recess is formed in the rear face of the base member, and the securing means comprises a backing sheet with double faced adhesive disposed in the shallow recess, the thickness of the backing sheet approximating the depth of the recess.

12. The mounting member defined by claim 9, wherein the securing means comprises at least one mounting hole in the base member and a fastening screw for each mounting hole.

13. The mounting member defined by claim 9, wherein the socket means comprises a U-shaped rib projecting forwardly from the front face of the base member.

14. The mounting member defined by claim 13, wherein the open part of said U-shaped rib faces upward.

15. The mounting member defined by claim 14, wherein the top of each leg of the U-shaped rib is flared outward.

16. The mounting member defined by claim 9, which further comprises frangible means projecting from the rear face of the base member defining lateral spaces on said rear face of differing width to fit over posts of varying size.

17. The mounting member defined by claim 16, wherein the frangible means comprises a plurality of pegs spaced from the respective side members and each other to define said lateral spaces of differing size, the pegs being selectively breakable away to accommodate a post of specific size.

18. The mounting member defined by claim 17, wherein the plurality of pegs are arranged in pairs, each pair being disposed in a line that is parallel to said side members.

19. The mounting member defined by claim 9, which includes two peg pairs arranged in a rectangular matrix, the pairs being symmetrically oriented on the rear face of the base member.

* * * * *